US007844206B2

(12) United States Patent
Kitao

(10) Patent No.: US 7,844,206 B2
(45) Date of Patent: Nov. 30, 2010

(54) IMAGE FORMING APPARATUS

(75) Inventor: Tomoyuki Kitao, Osaka (JP)

(73) Assignee: Kyocera Mita Corporation (JP)

( * ) Notice: Subject to any disclaimer, the term of this patent is extended or adjusted under 35 U.S.C. 154(b) by 60 days.

(21) Appl. No.: 12/426,806

(22) Filed: Apr. 20, 2009

(65) Prior Publication Data

US 2009/0263167 A1 Oct. 22, 2009

(30) Foreign Application Priority Data

Apr. 22, 2008 (JP) ..... 2008-111546

(51) Int. Cl.
*G03G 15/01* (2006.01)
*G03G 15/00* (2006.01)

(52) U.S. Cl. ..... 399/301; 399/49; 399/72

(58) Field of Classification Search ..... 399/49, 399/72, 301
See application file for complete search history.

(56) References Cited

U.S. PATENT DOCUMENTS 5,881,346 A * 3/1999 Mori et al. ..... 399/301
7,369,148 B2 5/2008 Shiraishi
7,471,308 B2 12/2008 Shiraishi
7,526,241 B2 * 4/2009 Kinoshita ..... 399/301
2009/0009582 A1 1/2009 Shiraishi

FOREIGN PATENT DOCUMENTS

JP 2004-268504 9/2004
JP 2004-358740 12/2004

* cited by examiner

*Primary Examiner*—Hoang Ngo
(74) *Attorney, Agent, or Firm*—Gerald E. Hespos; Michael J. Porco

(57) ABSTRACT

An image forming apparatus includes plural image forming sections for forming toner images of different colors. A patch toner image forming section forms patch toner images side-by-side onto a moving transfer body by using the image forming sections. A spread clock signal output section spreads a clock signal having a predetermined standard frequency at a predetermined spreading ratio and outputs the clock signal. A patch toner image intervals calculating section calculates intervals between the patch toner images on the transfer body based on the number of clock signals outputted from the spread clock signal output section and the standard frequency. A calculation result correcting section counts spread clock signals outputted during a time interval from the spread clock signal output section, and corrects a calculation result given by the patch toner image intervals calculating section based on the result of the counting.

6 Claims, 4 Drawing Sheets

IMAGE FORMING APPARATUS

BACKGROUND OF THE INVENTION

1. Field of the Invention

The present invention relates to image forming apparatuses such as a printer apparatus, a copying machine, a facsimile machine and a complex machine having functions of those. More specifically, it relates to an image forming apparatus having a spectrum spreading clock generator (SSCG) which spreads a clock signal having a predetermined standard frequency at a predetermined spreading ratio and outputs the same.

2. Description of the Related Art

There has been an image forming apparatus, such as a printer apparatus, a copying machine, a facsimile apparatus, and a complex machine having functions of those, having an SSCG (abbreviation of: Spread Spectrum Clock Generator) which spreads a clock signal having a predetermined standard frequency at a predetermined spreading ratio and outputs the same (for example, refer to Japanese Unexamined Patent Publication No. 2004-358740).

With use of the SSCG, a frequency of a clock signal used as an operation clock of various control circuits provided in the image forming apparatus is slightly changed, thereby lowering a peak value of a frequency spectrum and reducing a radiation noise.

Clock modulating methods of the SSCG include a center spread, which allows a clock signal having a standard frequency of 20 MHz to spread within a range of ±0.5% i.e. between 19.9-20.1 MHz, and a down spread, which allows a clock signal to spread within a range of −1% down to 19.8 MHz where the standard frequency of 20.0 MHz is maximum. At this time, a theoretical average value of the frequency of the clock signal in the center spread is 20.0 MHz, and a theoretical average value of the frequency of the clock signal in the down spread is 19.9 MHz.

However, depending on a precision error, characteristics, and use environment for each part of the SSCG, distortion may occur in a frequency of a clock signal outputted from the SSCG. Therefore, in a case where a clock signal outputted from the SSCG is used as an operation clock signal for a control circuit, an effect to a time-counting function of an internal counter of the control circuit is concerned.

In particular, in a tandem-type image forming apparatus which forms a color image by sequentially superimposing toner images of respective colors, which are formed on a plurality of photosensitive drums, onto a transfer body such as an intermediate transferring belt, a sheet, or the like, a resist correction processing for correcting misalignment in transfer positions of toner images is executed. In this resist correction processing, a counter value of a clock signal is used when detection intervals of patch images of respective colors transferred from photosensitive drums for respective colors onto the transfer body are measured. Therefore, in a case where distortion occurs in the frequency of the clock signal, detection intervals of patch images cannot be measured accurately, thereby causing a problem that correction precision in the resist correction processing is lowered.

SUMMARY OF THE INVENTION

An object of the present invention is to provide an image forming apparatus capable of correcting intervals of patch toner images on the transfer body at a high precision while reducing a radiation noise.

In order to achieve the aforementioned object, an image forming apparatus in accordance with an aspect of the present invention includes: a plurality of image forming sections for forming a plurality of toner images of different colors; a patch toner image forming section for forming a plurality of patch toner images side-by-side onto a moving transfer body by using the plurality of image forming sections; a spread clock signal output section for spreading a clock signal having a predetermined standard frequency at a predetermined spreading ratio and outputting the clock signal; a patch toner image intervals calculating section for calculating intervals between the patch toner images formed on the transfer body, based on the number of clock signals outputted from the spread clock signal output section and the standard frequency; and a calculation result correcting section for counting the number of spread clock signals outputted during a predetermined time interval from the spread clock signal output section, and correcting a calculation result given by the patch toner image intervals calculating section based on the result of the counting.

According to the configuration above, the calculation result correcting section counts the number of spread clock signals actually outputted during a predetermined time interval from the spread clock signal output section. If an error occurs in a frequency of spread clock signals outputted from the spread clock signal output section, an error also occurs in the number of spread clock signals counted during a predetermined time interval. Therefore, the calculation result correcting section can accurately correct a calculation result given by the patch toner image intervals calculating section based on the result of counting.

Accordingly, intervals of patch toner images on the transfer body can be corrected at a high precision with use of the spread clock signal output section while reducing a radiation noise.

These and other objects, features and advantages of the present invention will become more apparent upon reading of the following detailed description along with the accompanied drawings.

DETAILED DESCRIPTION OF THE PREFERRED EMBODIMENTS

First Embodiment

An embodiment of the present invention will be described with reference to FIGS. 1 to 4.

Figure 1:
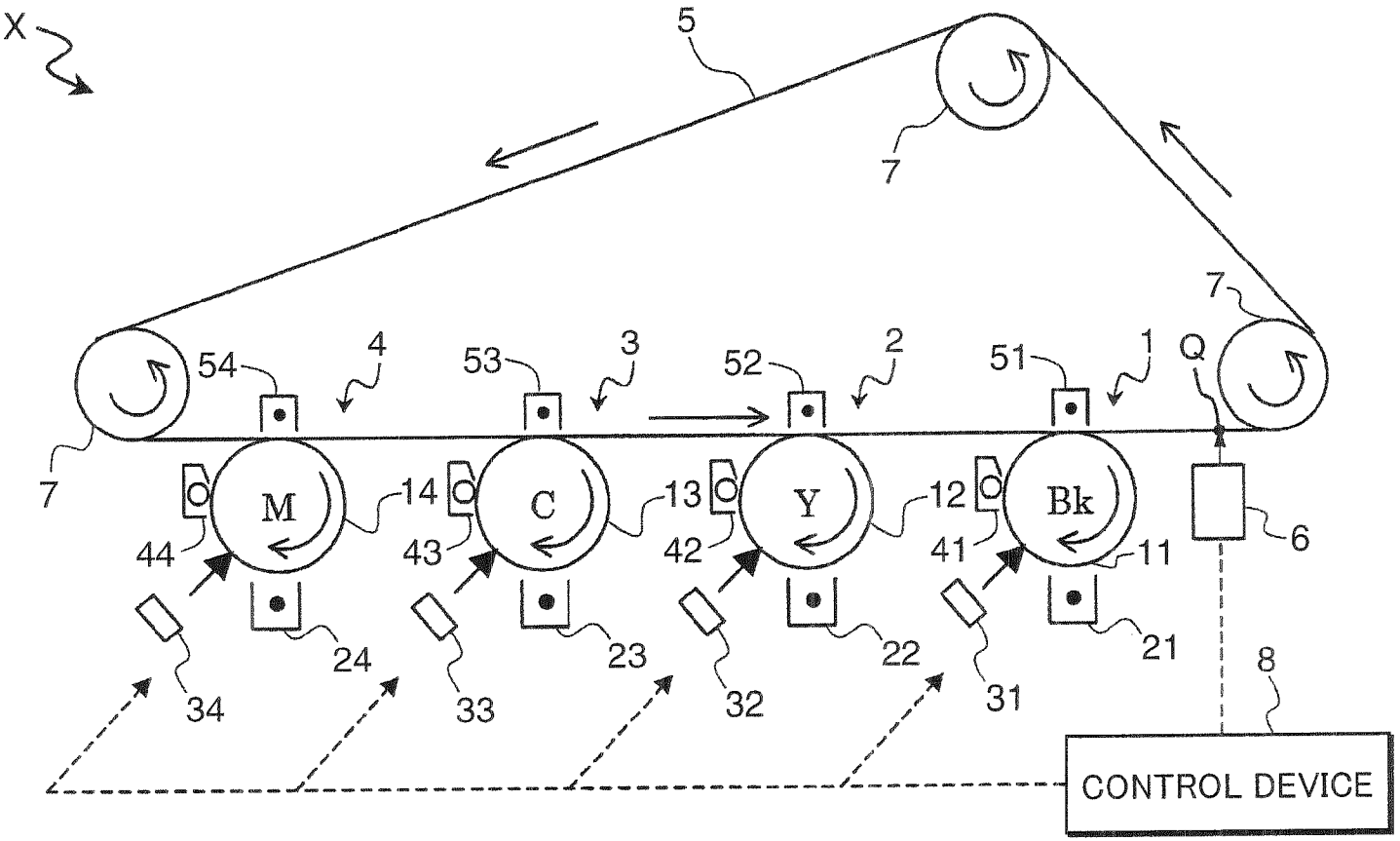
FIG. 1 schematically shows a configuration of a major portion of an image forming apparatus in accordance with an embodiment of the present invention.
Figure 2:
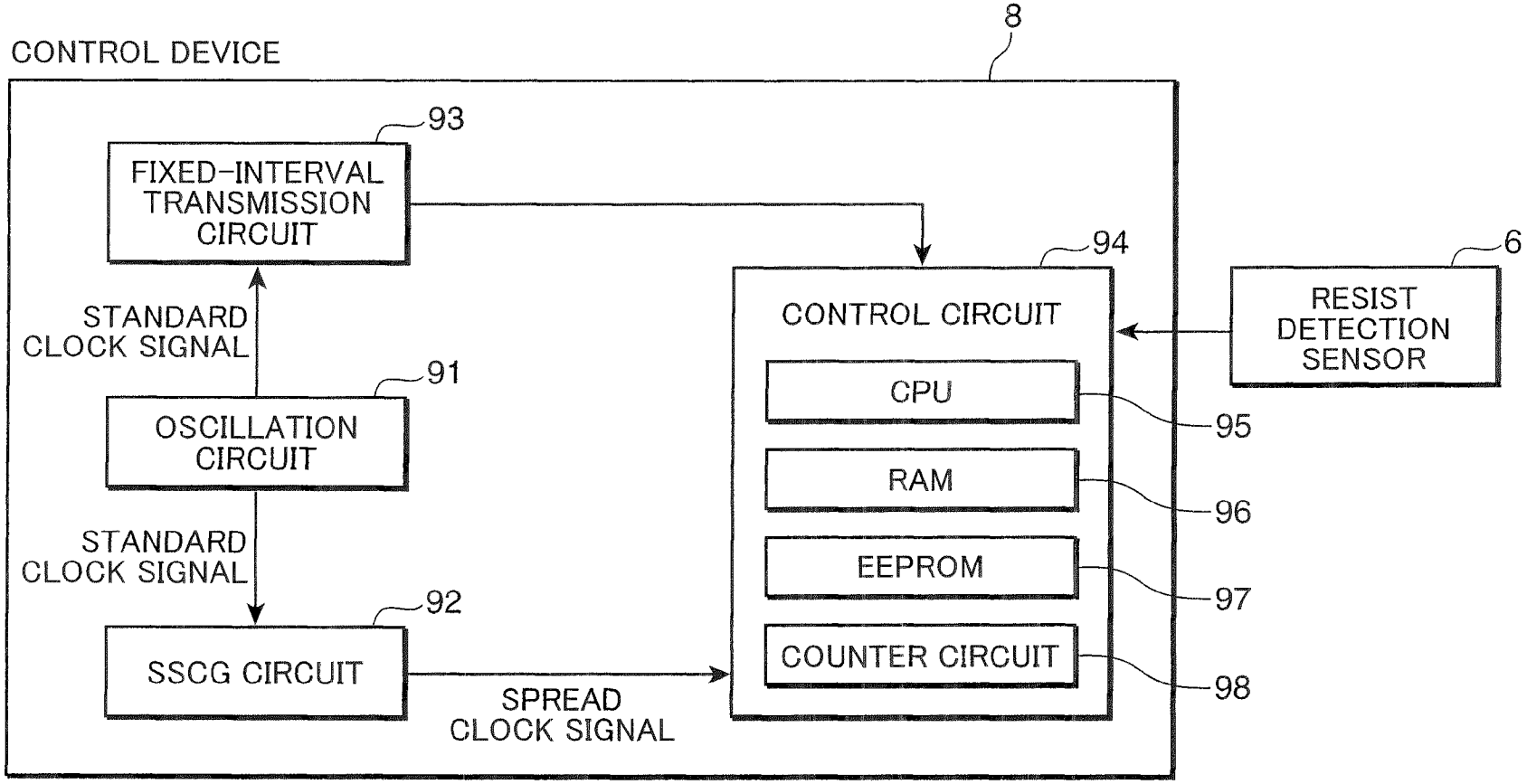
FIG. 2 is a block diagram showing a schematic configuration of a control device provided in the image forming apparatus according to the embodiment of the present invention.
Figure 3:
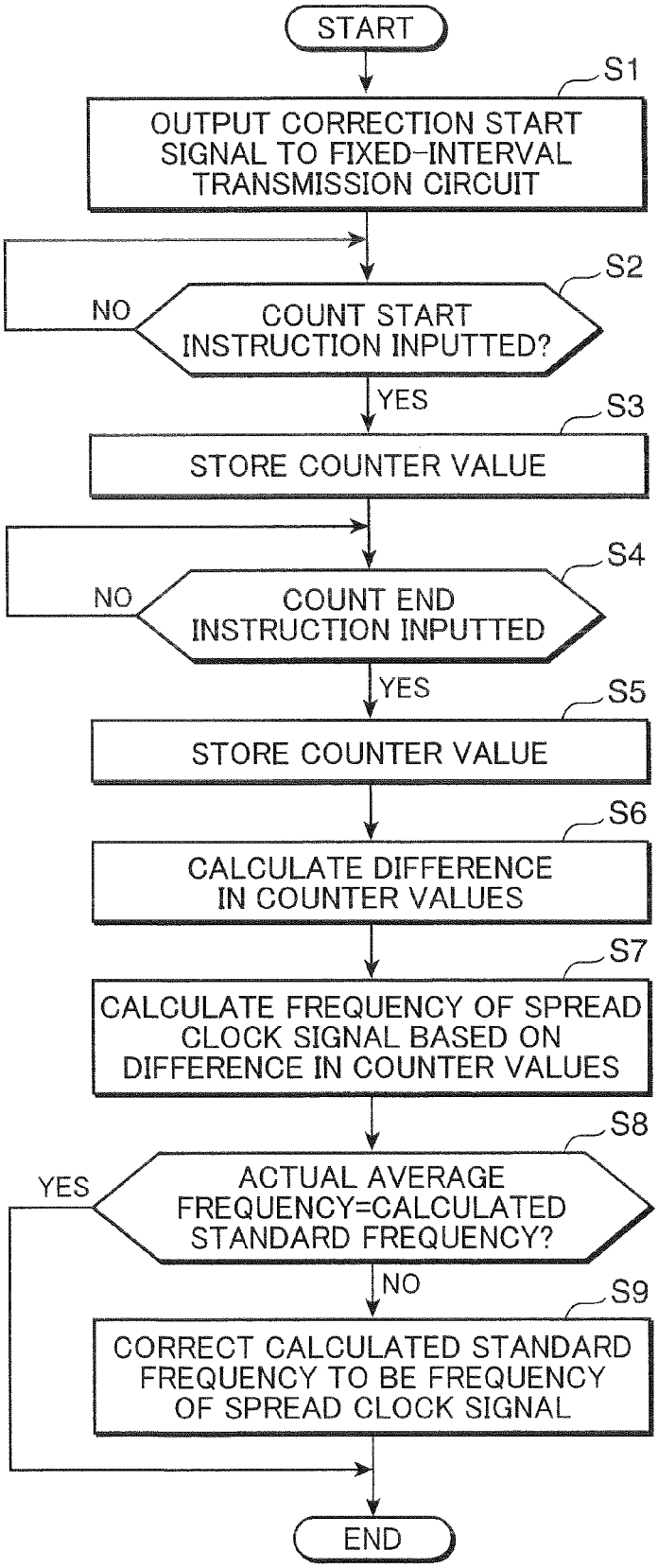
FIG. 3 is a flowchart showing an example of steps of a calculation standard frequency correction processing which is executed by the control device provided in the image forming apparatus according to the embodiment of the present invention.
Figure 4:
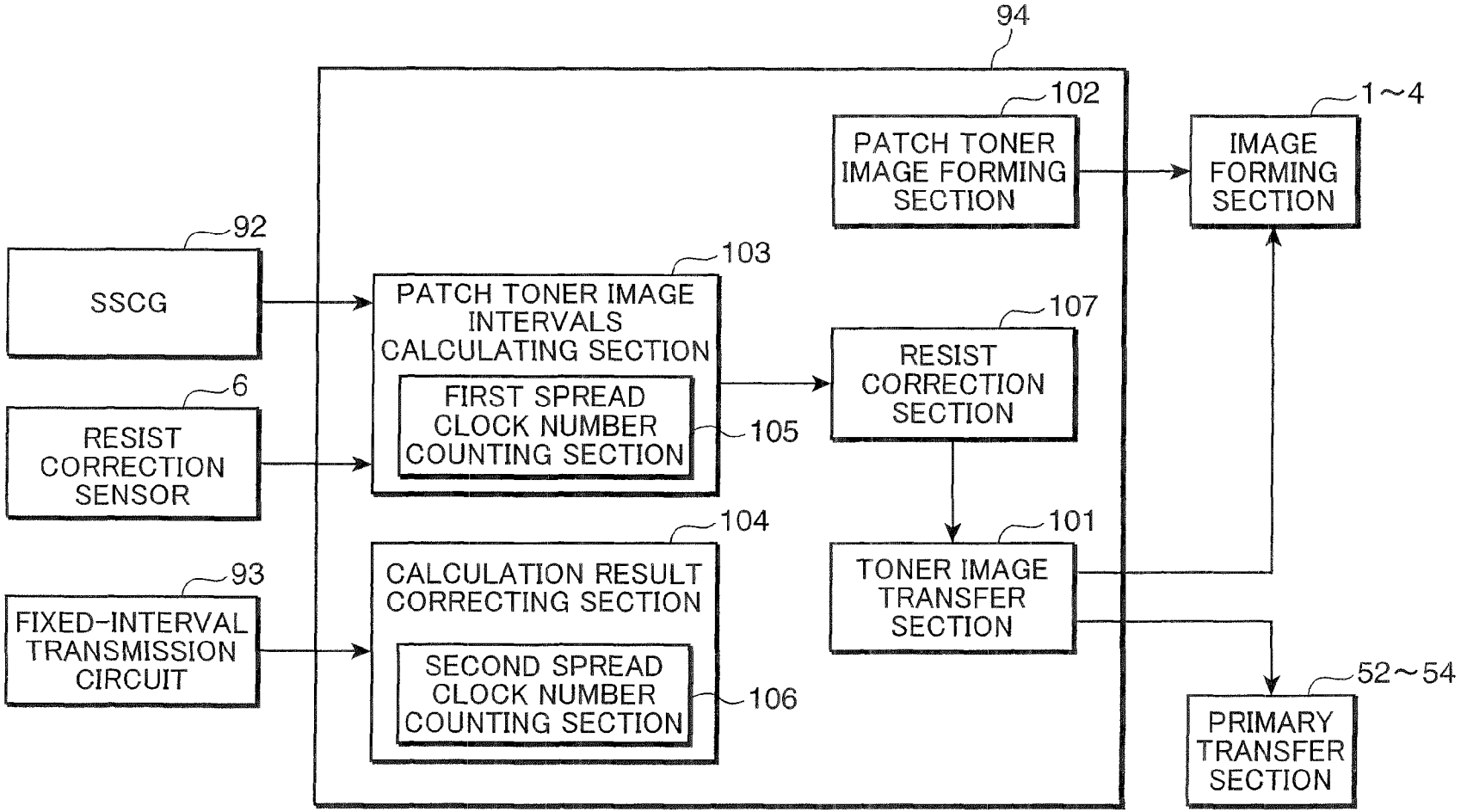
FIG. 4 is a function block diagram showing a schematic configuration of the control circuit of FIG. 2.

FIG. 1 schematically shows a configuration of a major portion of an image forming apparatus X in accordance with an embodiment of the present invention. FIG. 2 is a block diagram showing a schematic configuration of a control device 8 provided in the image forming apparatus X. FIG. 3 is a flowchart showing an example of steps of a calculation standard frequency correction processing executed by the control device 8. FIG. 4 is a function block diagram showing a schematic configuration of the control circuit of FIG. 2.

Firstly, a schematic configuration of the image forming apparatus X according to the embodiment of the present invention will be described with reference to FIG. 1. It should be understood that the image forming apparatus X according to the embodiment of the present invention may be, for example, a printer apparatus, a copying machine, a facsimile apparatus, and a complex machine having functions of those.

The image forming apparatus X according to the present embodiment is so-called tandem-type color image forming apparatus. As shown in FIG. 1, the image forming apparatus X includes a plurality of image forming sections 1 to 4 (image forming sections), an intermediate transfer belt 5 (transfer body), a resist correction sensor 6 (toner image detection section), belt support rollers 7, and the control device 8.

The image forming sections 1 to 4 form toner images of different colors respectively onto a plurality of photosensitive drums 11 to 14 (an example of photosensitive body) provided in line. The control device 8 has a control circuit 94 shown in FIG. 2, and controls the image forming sections 1 to 4 and primary transfer devices 52 to 54, which will be described later, in such a manner that the image forming sections 1 to 4 allow a plurality of toner images of different colors formed on the plurality of photosensitive drums 11 to 14 to be transferred onto a running (moving) intermediate transfer belt 5 sequentially in superimposition. As described above, the control circuit 94 of the control device 8 has a function of a toner image transfer section 101 (FIG. 4) which allows the plurality of toner images of different colors, which are formed on a plurality of image bearing members by the plurality of image forming sections 1 to 4, to be transferred to the moving transfer body sequentially in superimposition. In the example shown in FIG. 1, sequentially from a downstream side in a running direction of the intermediate transfer belt 5, there are provided an image forming section 1 for black (Bk), an image forming section 2 for yellow (Y), an image forming section 3 for cyan (C), and an image forming section 4 for magenta (M) in line.

The image forming section 1 for black (Bk) includes a photosensitive drum 11 which bears a toner image, a charging device 21 which charges a surface of the photosensitive drum 11, an exposure device 31 which irradiates a light to the charged surface of the photosensitive drum 11 to write an electrostatic latent image thereonto, a developing device 41 which develops the electrostatic latent image formed on the photosensitive drum 11 with toner, and a primary transfer device 51 which transfers the toner image formed on the rotating photosensitive drum 11 onto the moving intermediate transfer belt 5. Similarly, the image forming section 2 for yellow (Y), the image forming section 3 for cyan (C), and the image forming section 4 for magenta (M), include photosensitive drums 12 to 14 which bear toner images, charging devices 22 to 24 which charge surfaces of the photosensitive drums 12 to 14, exposure devices 32 to 34 which irradiate light to the charged surfaces of the photosensitive drums 12 to 14 to write electrostatic latent images thereonto, developing devices 42 to 44 which develop the electrostatic latent images formed on the photosensitive drums 12 to 14, and primary transfer devices 52 to 54 which transfer the toner images formed on the rotating photosensitive drums 12 to 14 onto the moving intermediate transfer belt 5. Although it is not illustrated in FIG. 1, the image forming sections 1 to 4 include cleaning devices and the like which remove residual toner images remained on the photosensitive drums 11 to 14.

The intermediate transfer belt 5 is an endless belt which is made of material such as rubber, urethane, or the like. The intermediate transfer belt 5 is supported and rotated by the belt support rollers 7. Accordingly, the intermediate transfer belt 5 moves (runs) while its surface is in contact with the surfaces of the photosensitive drums 11 to 14. Then, when the surface of the intermediate transfer belt 5 passes through between the photosensitive drums 11 to 14 and the primary transfer devices 51 to 54, toner images are transferred from the photosensitive drums 11 to 14 onto the surface of the intermediate transfer belt 5 sequentially in superimposition.

Although it is not illustrated in FIG. 1, the image forming apparatus X includes other constituting parts provided in a general electrophotographic-type image forming apparatus. For example, the image forming apparatus X includes a secondary transfer device which transfers a toner image from the intermediate transfer belt 5 onto a recording sheet, a fixing device which heat and fix the toner image transferred onto the recording sheet, a sheet-feeding cassette which stores the recording sheet, an operation display section for various operation display, and the like.

As described above, in the image forming apparatus X, the plurality of image forming sections 1 to 4 transfer the toner images of respective colors onto the running intermediate transfer belt 5 in superimposition, thereby forming a color toner image on the surface of the intermediate transfer belt 5. Further, the secondary transfer device (not illustrated) transfers the color toner image from the intermediate transfer belt 5 to a recording sheet, thereby forming a color image onto the recording sheet.

A configuration of the image forming apparatus according to the present embodiment is not limited to the aforementioned configuration. For example, the image forming apparatus may be so configured as to use the intermediate transfer belt 5 as a transfer belt and directly transfer the toner image in superimposition onto a sheet conveyed on the transfer belt. Also, a configuration of using a roller member in place of the intermediate transfer belt may be adopted.

The resist correction sensor 6 is so configured as to detect the toner images formed on the intermediate transfer belt 5 at a predetermined detection position Q (FIG. 1) on a moving path of the intermediate transfer belt 5.

Specifically, the resist correction sensor 6 irradiates a light onto the detection position Q on the intermediate transfer belt 5 to detect an intensity signal indicating intensity of a reflected light. The intensity signal (voltage signal) is inputted to the control device 8.

Next, a configuration and function of the control device 8 in accordance with the present embodiment will be described with reference to a mechanism block diagram of FIG. 2.

As shown in FIG. 2, the control device 8 includes an oscillation circuit 91, a spectrum spread clock generator (hereinafter, referred to as "SSCG") circuit 92, a fixed-interval transmission circuit 93, and a control circuit 94. The control circuit 94 includes a counter circuit 98 which counts the number of clock signals inputted to the control circuit 94. It goes without describing that the counter circuit 98 may be realized by a processing executed by the control circuit 94.

In the control device 8, the control circuit 94 determines reaching of the toner image to the detection position Q and density of the toner image, based on the intensity signal.

The resist correction sensor 6 may be used also as a density sensor for detection of density of the toner image transferred to the intermediate transfer belt 5, but it may be provided separately from the density sensor for the purpose of detecting patch images in a resist correction processing which will be described later.

The oscillation circuit 91 uses parts such as a crystal oscillator, a ceramic oscillator, or the like to generate a clock signal (which will be referred to as "standard clock signal") at a predetermined standard frequency and output the same. The standard clock signal outputted from the oscillation circuit 91 is inputted to the SSCG circuit 92 and the fixed-interval transmission circuit 93.

The control device 8 according to the present embodiment may be so configured as to include a known frequency dividing circuit which lowers a frequency of the standard clock signal outputted from the oscillation circuit 91 and inputs the same to the SSCG circuit 92 or the fixed-interval transmission circuit 93.

The SSCG circuit 92 (spread clock signal output section) has a function of spreading the standard clock signal, which has the standard frequency and inputted from the oscillation circuit 91, at a predetermined spreading ratio and outputting the same to reduce a radiation noise in the control device 8. Providing the SSCG circuit 92 having the aforementioned configuration makes it possible to lower a peak value of a frequency spectrum by slightly changing a frequency of the standard clock signal, thereby reducing a radiation noise. (Hereinafter, the clock signals outputted from the SSCG circuit 92 will be referred to as spread clock signals).

In the present embodiment, the SSCG circuit 92 performs a center-spread of ±0.5% with the standard frequency as an average value (hereinafter, referred to as "spread average frequency"). For example, in the case where the standard frequency is 20.0 MHz, the SSCG circuit 92 outputs spread clock signals spread within a range of 19.9-20.1 MHz.

The spread clock signals outputted from the SSCG circuit 92 are inputted to the control circuit 94 as operation clock signals. Accordingly, the control circuit 94 proceeds with various processing in accordance with spread clock signals inputted from the SSCG circuit 92.

At this time, in the control circuit 94, the counter circuit 98 counts the number of clocks (the number of rise and fall) of spread clock signals inputted from the SSCG circuit 92.

In the present embodiment, the fixed-interval transmission circuit 93 and the counter circuit 98 count the number of rise and fall of clock signals as the number of clocks. However, the present embodiment is not limited to this configuration. For example, only the rise of clock signal or only the fall of clock signal may be counted as the number of clocks.

The fixed-interval transmission circuit 93 has a time-counting function of counting time based on the standard clock signals having the standard frequency and inputted from the oscillation circuit 91. Specifically, the fixed-interval transmission circuit 93 may determine elapse of 1 msec by 2,000 counts of rise and fall of the standard clock signals in a case where the standard frequency is 1 MHz.

Further, the fixed-interval transmission circuit 93, when it receives a correction start signal from the control circuit 94, outputs a count start instruction to the control circuit 94. Thereafter, the fixed-interval transmission circuit 93 transmits a count end instruction to the control circuit 94 after elapse of a predetermined time period. In other words, the fixed-interval transmission circuit 93 outputs the count start instruction and the count end instruction at predetermined intervals. The fixed-interval transmission circuit 93, which executes the aforementioned processing, has a function as a count instructing section. Here, the count start instruction and the count end instruction are realized by rise and fall of count signals inputted to the control circuit 94.

The fixed-interval transmission circuit 93 is not limited to the aforementioned configuration as long as it can output the count start instruction and the count end instruction accurately at predetermined intervals. The fixed-interval transmission circuit 93 may have a unique time-measuring function.

As shown in FIG. 2, the control circuit 94 includes control sections (not illustrated) such as a CPU 95, a RAM 96, an EEPROM 97, and the counter circuit 98. The CPU 95 deploys a predetermined control program stored in the EEPROM 97 in the RAM 96, so that the control circuit 94 collectively controls constituting parts of the image forming apparatus X. For example, the control circuit 94 executes image forming processing by controlling the image forming sections 1 to 4.

Further, the control circuit 94 executes a resist correction processing for correcting color misalignment of a color toner image formed on the intermediate transfer belt 5 by the image forming sections 1 to 4, and a calculation standard frequency correction processing which will be described later (refer to the flowchart of FIG. 3).

Firstly, an example of the resist correction processing executed in the control circuit 94 will be described. The resist correction processing which will be described hereinafter is a mere example, and the resist correction processing can be executed by using other method.

In the resist correction processing, the control circuit 94 controls the image forming sections 1 to 4 to control the photosensitive drums 11 to 14 to form toner images having patch patterns (hereinafter, referred to as "patch image") of respective colors (black, yellow, cyan, and magenta) for resist correction onto an end portion of the intermediate transfer belt 5. As described above, the control circuit 94 has a function as a patch toner image forming section 102 (FIG. 4) which forms the patch images.

Next, the control circuit 94 executes a processing of measuring intervals of the patch images. Specifically, the control circuit 94 measures the number of clocks of spread clock signals which are outputted from the SSCG circuit 92 and counted by the counter circuit 98 during a period between detection of a first patch image and a second patch image by the resist correction sensor 6. After that, similarly, the control circuit 94 measures the number of clocks of the spread clock signals counted at detection intervals between the second patch image and a third patch image, and between the third patch image and a fourth patch image. The control circuit 94 has a function as a first spread clock number counting section 105 (FIG. 4) which executes a processing of counting the number of clocks.

Then, the control circuit 94 calculates time intervals and distance intervals between the patch images based on the number of clocks of the spread clock signals measured in the detection intervals of the patch images and a spread average frequency of the spread clock signals. As described above, the control circuit 94 has a function as a patch toner image intervals calculating section 103 (FIG. 4) which executes the calculation processing. Specifically, for example, in the case where the spread average frequency is 1 MHz, an elapse of 1 msec can be calculated if the number of clocks of the spread clock signals measured in the detection intervals of the patch images is 2,000 times. Further, the distances of detection intervals of the patch images can be calculated by multiplying that time by a running speed of the intermediate transfer belt 5.

As described above, in the resist correction processing according to the present embodiment, the spread average frequency and the number of clocks of the spread clock signals become standard for calculating intervals of the patch images. Hereinafter, the spread average frequency used as a standard for calculation in the resist correction processing will be referred to as a calculation standard frequency.

After that, the control circuit 94 corrects exposure timings of the exposure devices 31 to 34, a moving speed (rotational speed) of the intermediate transfer belt 5, and the like based on intervals of the patch images, and corrects misalignment of transfer positions of toner images transferred from the image forming sections 1 to 4 to the intermediate transfer belt 5. Accordingly, color misalignment can be prevented in a color image which is formed by superimposing the toner images formed in the image forming sections 1 to 4. As described above, the control circuit 94 has a function as a resist correction section 107 (FIG. 4) which executes the resist correction processing.

Meanwhile, in the resist correction processing, the control circuit 94 calculates the detection intervals of the patch images based on the number of spread clock signals and the calculation standard frequency. Therefore, in a case where the spread clock signals actually outputted from the SSCG circuit 92 are deviated from the calculation standard frequency, errors occur in detection intervals of the patch images, thereby causing a correction precision in the resist correction processing to be lowered.

In view of this, in the image forming apparatus X according to the embodiment of the present invention, as will be described hereinafter, the control circuit 94 executes the calculation standard frequency correction processing. Specifically, the calculation standard frequency used for calculating detection intervals of the patch images is corrected, thereby preventing errors in the detection intervals of patch images in the resist correction processing.

Hereinafter, an example of steps of the calculation standard frequency correction processing executed by the control circuit 94 will be described with reference to the flowchart in FIG. 3.

The calculation standard frequency correction processing is suitably executed, for example, at a time of starting operation of the image forming apparatus X, or at an elapse of a predetermined time period. If the calculation standard frequency correction processing is executed immediately before execution of the resist correction processing or during execution of the resist correction processing, errors in detection intervals of patch images in the resist correction processing can be corrected at a high precision.

(Step S1)

Firstly, the control circuit 94 outputs the correction start signal with respect to the fixed-interval transmission circuit 93 (Step S1). Accordingly, in response to the reception of the correction start signal, the fixed-interval transmission circuit 93 inputs the count start instruction (rise of count signal) and the count end instruction (fall of count signal) to the control circuit 94 at predetermined intervals.

Here, the predetermined interval may be suitably set in accordance with precision required for correction by the calculation standard frequency correction processing. For example, in a case where the spread average frequency is 20 MHz, and an actual average frequency (an average value of frequency of spread clock signals outputted actually outputted from the SSCG circuit 92) which will be described later should be detected at precision of 0.1% (in units of 20 kHz), the predetermined interval may be set to be a time period during which the number of clocks (the number of rises and falls) of the spread clock signals outputted from the SSCG circuit 92 becomes greater than 20,000 times. Specifically, since the spread average frequency is 20 MHz, the predetermined intervals may be set to be 0.5 msec during which the number of clocks counted in the counter circuit 98 may reach 20,000 times (10,000 clock signals). As mentioned above, the fixed-interval transmission circuit 93 determines the time period of 0.5 msec based on the number of standard clock signals inputted by the oscillation circuit 91.

(Steps S2 to S6)

Next, in step S2, the control circuit 94 waits for input of the count start instruction from the fixed-interval transmission circuit 93 (NO in step S2). Then, when the control circuit 94 determines that the count start instruction is inputted from the fixed-interval transmission circuit 93 (YES in step S2), the processing proceeds to step S3.

The control circuit 94 temporarily stores a count value given by the counter circuit 98 as a start count value into a storage section such as an internally provided RAM or the like (step S3). The count processing executed by the counter circuit 98 may be started in accordance with an instruction given by the control circuit 94, and in such case, the start count value is 0.

Thereafter, the control circuit 94 waits for an input of a count end instruction from the fixed-interval transmission circuit 93 (NO in step S4). Then, when the control circuit 94 determines that the count end instruction is inputted from the fixed-interval transmission circuit 93 (YES in step S4), the processing proceeds to step S5.

The control circuit 94 temporarily stores a current counter value given by the counter circuit 98 as an end count value into a storage section such as an internally provided RAM or the like (step S5). The count by the counter circuit 98 may be reset at this point of time.

Thereafter, the control circuit 94 calculates the difference between the start counter value and the end counter value stored in steps S3 and S5. Accordingly, the number of clocks of spread clock signals inputted from the SSCG circuit 92 during a predetermined interval between output of the count start instruction and output of the count end instruction in the fixed-interval transmission circuit 93 is calculated (S6). As described above, the control circuit 94 has a function as a second spread clock number counting section 106 (FIG. 4) which executes the aforementioned calculation processing.

(Steps S7 and S8)

Next, the control circuit 94 calculates an average value of frequencies of spread clock signals actually outputted from the SSCG circuit 92 based on the number of clocks of spread clock signals calculated in step S6 (step S7). Hereinafter, the value calculated here is referred to as actual average frequency.

Then, the control circuit 94 determines whether or not the actual average frequency calculated in step S7 and the calculation standard frequency are equal (step S8). Here, if the actual average frequency calculated in step S7 and the calculation standard frequency are equal (YES in S8), the calculation standard frequency correction processing is terminated without execution of next step S9. In other words, in this case, an error has not occurred in the spread clock signals outputted from the SSCG circuit 92. Therefore, measurement of detection intervals of the patch images in the resist correction processing executed by the control circuit 94 can be performed accurately, thereby securing a high correction precision in the resist correction processing.

(Step S9)

On the other hand, in a case where the actual average frequency calculated in step S7 and the calculation standard frequency are different from each other (NO in S8), it seems that an error occurs in frequencies of spread clock signals outputted from the SSCG circuit 92.

Therefore, in this case, the control circuit 94 allows the processing to proceed to step S9 and corrects the calculation standard frequency based on the actual average frequency calculated in step S7. Specifically, the control circuit 94 changes the calculation standard frequency to be the actual average frequency. Accordingly, in the resist correction processing, the calculation standard frequency used for calculation of detection intervals of the patch images is corrected to be an average value of frequencies of spread clock signals actually outputted from the SSCG circuit 92. Then, the change made in step S9 is considered to be maintained until the power of the image forming apparatus X is turned off or until next calculation standard frequency correction processing is executed.

It should be understood that the change made in step S9 is only for a value of the calculation standard frequency used for calculation of detection intervals of the patch images, and the spread average frequency as a standard for spread in the SSCG circuit 92 is not changed. In other words, the actual average frequency is merely substituted into the calculation standard frequency for calculation of detection intervals of the patch images.

As described above, if the calculation standard frequency is corrected, in the resist correction processing executed by the control circuit 94 thereafter, calculation of detection intervals of the patch images is executed based the calculation standard frequency corrected in the calculation standard frequency correction processing, so that misalignment of transfer positions of toner images of respective colors transferred to the photosensitive drums 11 to 14 is corrected based on the calculation result. In other words, the control circuit 94 corrects the calculation standard frequency to thereby correct calculation result of detection intervals of the patch images in the resist correction processing. Here, the control circuit for execution of the correction processing corresponds to the calculation result correcting section 104 (FIG. 4). Accordingly, in the resist correction processing, detection intervals of the patch images can be accurately calculated, so that the resist correction can be performed at high precision.

As described above, in the image forming apparatus X, the calculation standard frequency correction processing is executed, so that while use of spread clock signals from the SSCG circuit 92 as operation clock of the control circuit 94 reduces radiation noise, correction precision in the resist correction processing executed by the control circuit 94 can be enhanced.

In the present embodiment, the case where the calculation standard frequency is corrected is described. However, the present invention is not limited to this case. As another embodiment, the intervals of the patch images calculated based on the calculation standard frequency can be corrected based on the number of clocks of the spread clock signals measured in step S7.

Further, the number of clock signals of the spread clock signals counted for finding the detection intervals of the patch images in the resist correction processing can be corrected each time based on the number of clocks of the spread clock signals counted during the predetermined interval. For example, in the case where the spread average frequency is 1 MHz (in other words, the number of clocks per 1 msec (sum of rise and fall) is 2,000 times), if the number of clocks of the latter counted in 1 msec is 1,900, calculation result of detection intervals of the patch images can be corrected by correcting the number of clocks by multiplying the former number of clocks by (2,000/1900). The control circuit 94 for execution of such correction processing is also an example of the calculation result correcting section.

The present invention may be used for image forming apparatuses such as a printer apparatus, a copying machine, a facsimile apparatus, and a complex machine having functions of those.

An image forming apparatus according to an aspect of the present invention includes: a plurality of image forming sections for forming a plurality of toner images of different colors; a patch toner image forming section for forming a plurality of patch toner images side-by-side onto a moving transfer body by using the plurality of image forming sections; a spread clock signal output section for spreading a clock signal having a predetermined standard frequency at a predetermined spreading ratio and outputting the clock signal; a patch toner image intervals calculating section for calculating intervals between the patch toner images formed on the transfer body, based on the number of clock signals outputted from the spread clock signal output section and the standard frequency; and a calculation result correcting section for counting the number of spread clock signals outputted during a predetermined time interval from the spread clock signal output section, and correcting a calculation result given by the patch toner image intervals calculating section based on the result of the counting.

According to the configuration above, the calculation result correcting section counts the number of spread clock signals actually outputted during a predetermined time period from the spread clock signal output section. If an error occurs in a frequency of the spread clock signals outputted from the spread clock signal output section, an error also occurs in the number of spread clock signals counted during a predetermined time period. Therefore, the calculation result correcting section can accurately correct a calculation result given by the patch toner image intervals calculating section based on the result of counting.

Accordingly, intervals of patch toner images on the transfer body can be corrected at a high precision with use of the spread clock signal output section while reducing radiation noise.

In the configuration above, it is preferable that the image forming apparatus further includes: a toner image transfer section for transferring the plurality of toner images having different colors, which are formed respectively on a plurality of image bearing members by the plurality of image forming sections, onto the moving transfer body sequentially in superimposition; and a resist correction section for correcting shifts of transfer positions, at which the plurality of toner images having different colors are transferred in superimposition onto the transfer body, based on a calculation result given by the patch toner image intervals calculating section, and the resist correction section corrects the transfer positions of the toner images of respective colors onto the transfer body based on the calculation result given by the patch toner image intervals calculating section and corrected by the calculation result correcting section.

According to the configuration above, the resist correction section corrects shifts of transfer positions, at which the plurality of toner images having different colors are transferred in superimposition onto the transfer body, based on a calculation result given by the patch toner image intervals calculating section. Here, since the calculation result given by the patch toner image intervals calculating section is the one corrected by the calculation result correcting section, precision in correction by the resist correction section can be enhanced. Thus, a high precision in correction by the resist correction section can be secured while reducing radiation noise with use of the spread clock signal output section.

In the configuration above, it is preferable that the image forming apparatus further includes: a toner image detection section for detecting the toner images formed on the transfer body at a predetermined detection position, and the patch toner image intervals calculating section includes a first spread clock number counting section for counting the number of clock signals outputted from the spread clock signal output section while the patch toner images are detected by the toner image detection section, and detection intervals of the patch toner images are calculated based on the count values given by the first spread clock number counting section and the standard frequency.

In the configuration above, a count instructing section may be provided for outputting a count start instruction and a count end instruction at a predetermined interval, wherein the calculation result correcting section includes a second spread clock number counting section for counting the number of spread clock signals outputted from the spread clock signal output section during when the count start instruction is outputted by the count instructing section and the count end instruction is outputted, and the calculation result given by the patch toner image intervals calculating section may be corrected based on the count result given by the second spread clock number counting section.

In the configuration above, the calculation result correcting section may correct the value of standard frequency used for calculation by the patch toner image intervals calculating section, thereby correcting a calculation result given by the patch toner image intervals calculating section.

In the configuration above, the calculation result correcting section may correct the count value given by the first spread clock number counting section, thereby correcting a calculation result given by the patch toner image intervals calculating section.

This application is based on Japanese Patent application serial No. 2008-111546 filed in Japan Patent Office on Apr. 22, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

a plurality of image forming sections for forming a plurality of toner images of different colors;

a patch toner image forming section for forming a plurality of patch toner images side-by-side onto a moving transfer body by using the plurality of image forming sections;

a spread clock signal output section for spreading a clock signal having a predetermined standard frequency at a predetermined spreading ratio and outputting the clock signal;

a patch toner image intervals calculating section for calculating intervals between the patch toner images formed on the transfer body, based on the number of clock signals outputted during a predetermined time interval from the spread clock signal output section and the standard frequency; and a calculation result correcting section for counting the number of spread clock signals outputted from the spread clock signal output section at a predetermined time interval, and correcting a calculation result given by the patch toner image intervals calculating section based on the result of the counting.

2. The image forming apparatus according to claim 1, further comprising:

a toner image transfer section for transferring the plurality of toner images having different colors, which are formed respectively on a plurality of image bearing members by the plurality of image forming sections, onto the moving transfer body sequentially in superimposition; and a resist correction section for correcting shifts of transfer positions, at which the plurality of toner images having different colors are transferred in superimposition onto the transfer body, based on a calculation result given by the patch toner image intervals calculating section, wherein the resist correction section corrects the transfer positions of the toner images of respective colors onto the transfer body based on the calculation result given by the patch toner image intervals calculating section and corrected by the calculation result correcting section.

3. The image forming apparatus according to claim 1, further comprising:

a toner image detection section for detecting the toner images formed on the transfer body at a predetermined detection position, wherein the patch toner image intervals calculating section includes a first spread clock number counting section for counting the number of clock signals outputted from the spread clock signal output section while the patch toner images are detected by the toner image detection section, and detection intervals of the patch toner images are calculated based on the count values given by the first spread clock number counting section and the standard frequency.

4. The image forming apparatus according to claim 1, further comprising:

a count instructing section for outputting a count start instruction and a count end instruction at a predetermined interval, wherein the calculation result correcting section includes:

a second spread clock number counting section for counting the number of spread clock signals outputted from the spread clock signal output section during when the count start instruction is outputted by the count instructing section and the count end instruction is outputted, and the calculation result given by the patch toner image intervals calculating section is corrected based on the count result given by the second spread clock number counting section.

5. The image forming apparatus according to claim 2, wherein the calculation result correcting section corrects the value of standard frequency used for calculation by the patch toner image intervals calculating section, thereby correcting a calculation result given by the patch toner image intervals calculating section.

6. The image forming apparatus according to claim 3, wherein the calculation result correcting section corrects the count value given by the first spread clock number counting section, thereby correcting a calculation result given by the patch toner image intervals calculating section.

* * * * *